US011142943B2

(12) United States Patent
Patel

(10) Patent No.: US 11,142,943 B2
(45) Date of Patent: Oct. 12, 2021

(54) VENTILATION SYSTEM INTEGRATED WITHIN WINDOW FRAME

(71) Applicant: Sonesh Patel, Austin, TX (US)

(72) Inventor: Sonesh Patel, Austin, TX (US)

( * ) Notice: Subject to any disclaimer, the term of this patent is extended or adjusted under 35 U.S.C. 154(b) by 193 days.

(21) Appl. No.: 16/170,957

(22) Filed: Oct. 25, 2018

(65) Prior Publication Data

US 2019/0128053 A1 May 2, 2019

Related U.S. Application Data

(60) Provisional application No. 62/577,688, filed on Oct. 26, 2017.

(51) Int. Cl.

| | |
|---|---|
| ***E06B 7/02*** | (2006.01) |
| ***F24F 7/013*** | (2006.01) |
| ***E06B 7/10*** | (2006.01) |
| ***F24F 8/10*** | (2021.01) |
| ***E06B 3/984*** | (2006.01) |
| ***F24F 13/28*** | (2006.01) |
| ***E06B 5/10*** | (2006.01) |

(52) U.S. Cl.

CPC ..... *E06B 7/02* (2013.01); *E06B 5/10* (2013.01); *E06B 7/10* (2013.01); *F24F 7/013* (2013.01); *F24F 8/10* (2021.01); *E06B 3/984* (2013.01); *E06B 2007/023* (2013.01); *F24F 13/28* (2013.01); *F24F 2221/20* (2013.01)

(58) Field of Classification Search

CPC ..... E06B 7/02; E06B 7/10; E06B 5/10; E06B 3/984; E06B 2007/023; F24F 3/1603; F24F 7/013; F24F 13/28; F24F 2221/20

USPC ..... 454/207, 196, 212, 211

See application file for complete search history.

(56) References Cited

U.S. PATENT DOCUMENTS

| | | | | |
|---|---|---|---|---|
| 2,324,139 | A * | 7/1943 | Davis | E06B 7/03 160/43 |
| 2002/0189770 | A1* | 12/2002 | Van Hee | E06B 9/11 160/210 |
| 2007/0135034 | A1* | 6/2007 | Lack | B60J 1/20 454/196 |

(Continued)

FOREIGN PATENT DOCUMENTS

| | | | | |
|---|---|---|---|---|
| EP | 3217015 | A1 * | 9/2017 | F04D 27/003 |
| JP | 2015224433 | * | 12/2015 | |

(Continued)

*Primary Examiner* — Steven B McAllister
*Assistant Examiner* — Charles R Brawner
(74) *Attorney, Agent, or Firm* — Andrew Morabito

(57) ABSTRACT

A ventilated window frame comprising; a frame having a plurality of slots along an interior edge and a channel having a first opening and a second opening, a permeable layer fitted within one of the plurality of slots distal to the first edge of the frame, a permeable layer secured within one of the plurality of slots distal to the second edge of the frame, a non-permeable layer secured within one of the plurality of slots between the first and second permeable layers, wherein the first opening of the channel is between the first permeable layer and the non-permeable layer and the second opening of the channel is located between the second permeable layer and the non-permeable layer, a filter inserted within the first opening of the channel, and a fan fitted between the first opening and the second opening of the channel.

16 Claims, 8 Drawing Sheets

(56) References Cited

U.S. PATENT DOCUMENTS

| | | | | |
|---|---|---|---|---|
| 2013/0180675 | A1* | 7/2013 | Bates | E06B 9/52 160/381 |
| 2015/0300677 | A1* | 10/2015 | Wang | E06B 7/02 96/384 |
| 2017/0170776 | A1* | 6/2017 | Janowski | G02F 1/137 |
| 2018/0224139 | A1* | 8/2018 | Watkins | F24F 13/15 |

FOREIGN PATENT DOCUMENTS

| | | | | |
|---|---|---|---|---|
| JP | 2015224433 | A * | 12/2015 | |
| WO | WO-9604451 | A1 * | 2/1992 | E06B 3/46 |

* cited by examiner

VENTILATION SYSTEM INTEGRATED WITHIN WINDOW FRAME

CROSS-REFERENCE TO RELATED APPLICATIONS

This application is a continuation-in-part (and claims the benefit of priority under 35 USC 120) of U.S. provisional patent application No. 62/577,688 filed Oct. 26, 2018. The disclosure of the prior applications is considered part of (and is incorporated by reference in) the disclosure of this application.

BACKGROUND OF THE INVENTION

The present invention relates to window frame assembly, and more particularly to a window frame assembly with an integrated ventilation system.

Air pollution is a widely recognized issue that has been vastly exacerbated by the increase in fossil fuel consumption over the past century. It is a wide moniker that mainly consists of fine particulate pollution (diameters ≤2.5 um), ground-level ozone, carbon monoxide (CO), nitrogen oxides (NOx), volatile organic compounds (VOCs), and heavy metals. All of the aforementioned forms of air pollution have been shown to have chronic and acute effects on health that range from curable changes in respiratory function and structural changes to pulmonary airways to increased respiratory mortality and impairment of pulmonary defense. Equally problematic, but less frequently studied is indoor air pollution, a top five environmental health risk according to the Environmental Protection Agency (EPA). Fortunately, across a broad range of filtration studies, it was found that the percent improvement in health outcomes after implementation of a centralized filtration system ranged from 7% to 25%. Despite the effectiveness of even the most rudimentary filtration and ventilation systems and the debilitating effects of air pollution, a product that can simultaneously filter out indoor air pollution while allowing purified air to enter hasn't been developed yet.

Indoor air pollution, caused by cooking, burning, household cleaners, room fresheners, mold, and building materials, can be ten times as toxic as outdoor air pollution. It is a leading cause of suffering among the 230 million people diagnosed with pulmonary disease worldwide and is correlated with increased mortality rates. Ironically, the most effective solution is to open your windows and let fresh air in. However, outside air is also likely to be contaminated with pollutants, allergens, and pathogens that may lead to cancer, respiratory issues, reduced fertility and other health problems.

In addition, both indoor and outdoor air pollution have serious economic implications. In fact, it was found that air pollution will result in 3.75 billion missed work days and annual market costs of 1% of the global GDP by 2060. For our economic, social, and physical well-being it is imperative to develop a device or integrated system that limits our exposure to all forms of air pollution. Essentially, we are in dire need of a product that prevents in the entry of outdoor air pollution while simultaneously allowing indoor air pollution to diffuse out.

It is important to understand the prevalence and deleterious effects of both indoor and outdoor air pollution. This is especially crucial now as the increased release of fossil fuels has resulted in dangerously high amounts of hazardous chemicals in the atmosphere. Increased emissions are primarily responsible for the surge in air particulate pollution.

The largest health concern comes from fine particulate pollution (diameters ≤2.5 urn). According to a study led by Arden C. Pope, fine particles, such as sulfates and $PM_{2.5}$ (particulate pollution of diameter ≤2.5 μm), result primarily from the combustion of fossil fuels.

While fine particulate pollution poses the largest risk, ground-level ozone or smog is the most common form of outdoor air pollution. Smog has been shown to intensify allergy symptoms and increase the likelihood of asthma exacerbations. Other common air pollutants, such as nitrogen oxides (NOx), carbon monoxide (CO), volatile organic compounds (VOCs), respirable particulate matter ($PM_{2.5}$ and $PM_{10}$). These responses range from curable changes in respiratory function and structural changes to pulmonary airways to increased respiratory mortality and impairment of pulmonary defense. Outdoor air pollution can also cause lung cancer and exemplify existing heart and lung disease conditions. Specifically, PM 10 has been linked to decreased lung functionality, exacerbated asthma symptoms, and higher rates of premature mortality in children and the elderly (Bernard et al., 2001). Low trace amounts of carbon monoxide (CO) negatively affect almost all of the population, decreasing exercise capability and causing angina pectoris. While the effects of carbon monoxide, particulate matter, nitrogen dioxide, and acid aerosols can be measured in a long-term context, sulfur dioxide only has short-term effects. Despite only having effects that can be measured in the short-term, overexposure can still result in decreased lung function and death.

The impact of urban ambient air pollution was estimated in terms of mortality and morbidity percentages. As with other studies, particulate pollution had a clear and independent relation with increased morbidity and mortality. The most serious reactions to air pollution exposure included but were not limited to lung cancer and other causes of cardiopulmonary mortality. Around 3% of the mortality rate for adults suffering cardiopulmonary disease can be attributed to outdoor particulate pollution. Furthermore, it is also responsible for around 5% of trachea, lung cancer, and bronchus related mortalities. This culminates to about 6.4 million lost life years and 0.8 million premature deaths annually.

Outdoor air pollution has been tied to numerous other health problems, the most influential of which being fertility. In the past, it was largely assumed that air pollution mainly affected males by lowering their sperm count. However, in a 2005 study conducted on female BALB/c mice, it was found that exposure to air pollution (especially $PM_{10}$ and $NO_2$) had a significant impact on the number of live-born pups and the prevalence of implantation failure.

From an economic standpoint, the effects of both indoor and outdoor air pollution are also notable. A study conducted in Singapore found nationwide implementation of mechanical ventilation and filtration in homes would result in a "lower mortality rate (10% and 6% respectively)", a "lower morbidity rate (8% and 4% respectively)" and "economic savings of $1.5 and $0.9 billion respectively" when compared to the current state. The related savings were about nine times the energy cost for air conditioning. Enhanced workplace filtration reduced the mortality rate by 14% and morbidity cases by 13%, resulting in savings totaling USD 2.4 billion. This study illustrates the positive economic and health impacts that filtration can have. Although filtration can reduce exposure to both outdoor and indoor air pollution, the majority of filtration systems do not address both problems simultaneously. The EPA states that simply opening your windows is the best way to combat indoor air pollution. However, doing so increases exposure to outdoor pollutants. Given the detrimental effects of both indoor and outdoor air pollution, a novel approach to addressing the problems of indoor and outdoor is desperately needed. The goal of this invention is to create a device that can draw in fresh, purified air and remove air contaminated with indoor pollutants.

A device with primary airflow occurring at the top of a window frame through a filter unit placed in between the outside and middle layers. Air is pulled in through the outside pane by an array of fans located in the central frame, gets filtered as it passes through a filtration unit and exits through the micro-holes in the pane of glass closest to the interior environment.

SUMMARY

One embodiment of the present invention is a ventilated window frame comprising; a frame having a plurality of slots along an interior edge and a channel having a first opening and a second opening, providing passage from a first edge of the frame to a second edge of the frame, a first permeable layer fitted within one of the plurality of slots distal to the first edge of the frame, a second permeable layer secured within one of the plurality of slots distal to the second edge of the frame, a non-permeable layer secured within one of the plurality of slots between the first and second permeable layers, wherein the first opening of the channel is between the first permeable layer and the non-permeable layer and the second opening of the channel is located between the second permeable layer and the non-permeable layer, a filter inserted within the first opening of the channel, and a fan fitted between the first opening and the second opening of the channel.

DETAILED DESCRIPTION OF THE INVENTION

Figure 1:
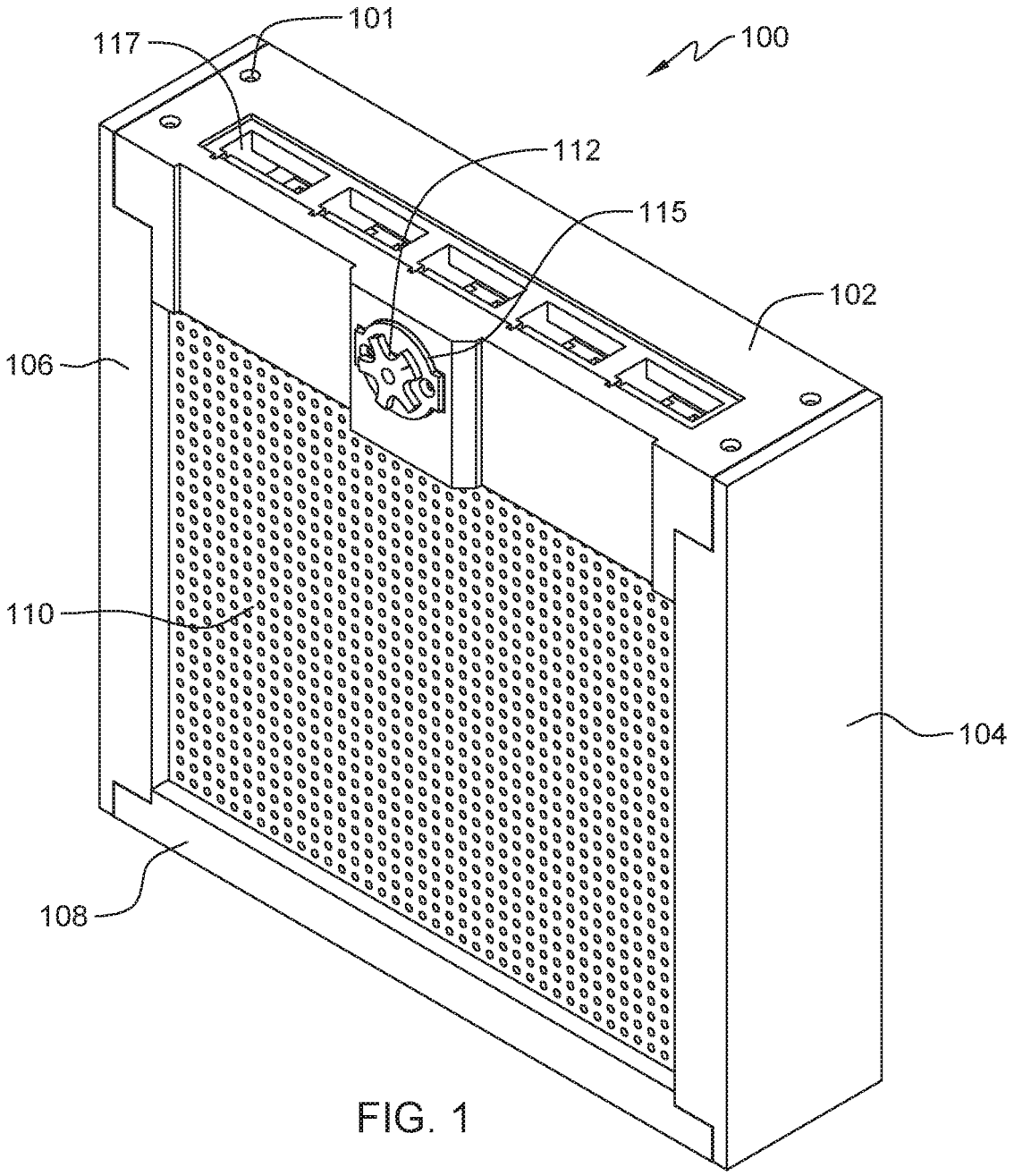
FIG. 1 depicts an isometric view of a front view of a window, in accordance with one embodiment of the present invention.
Figure 2:
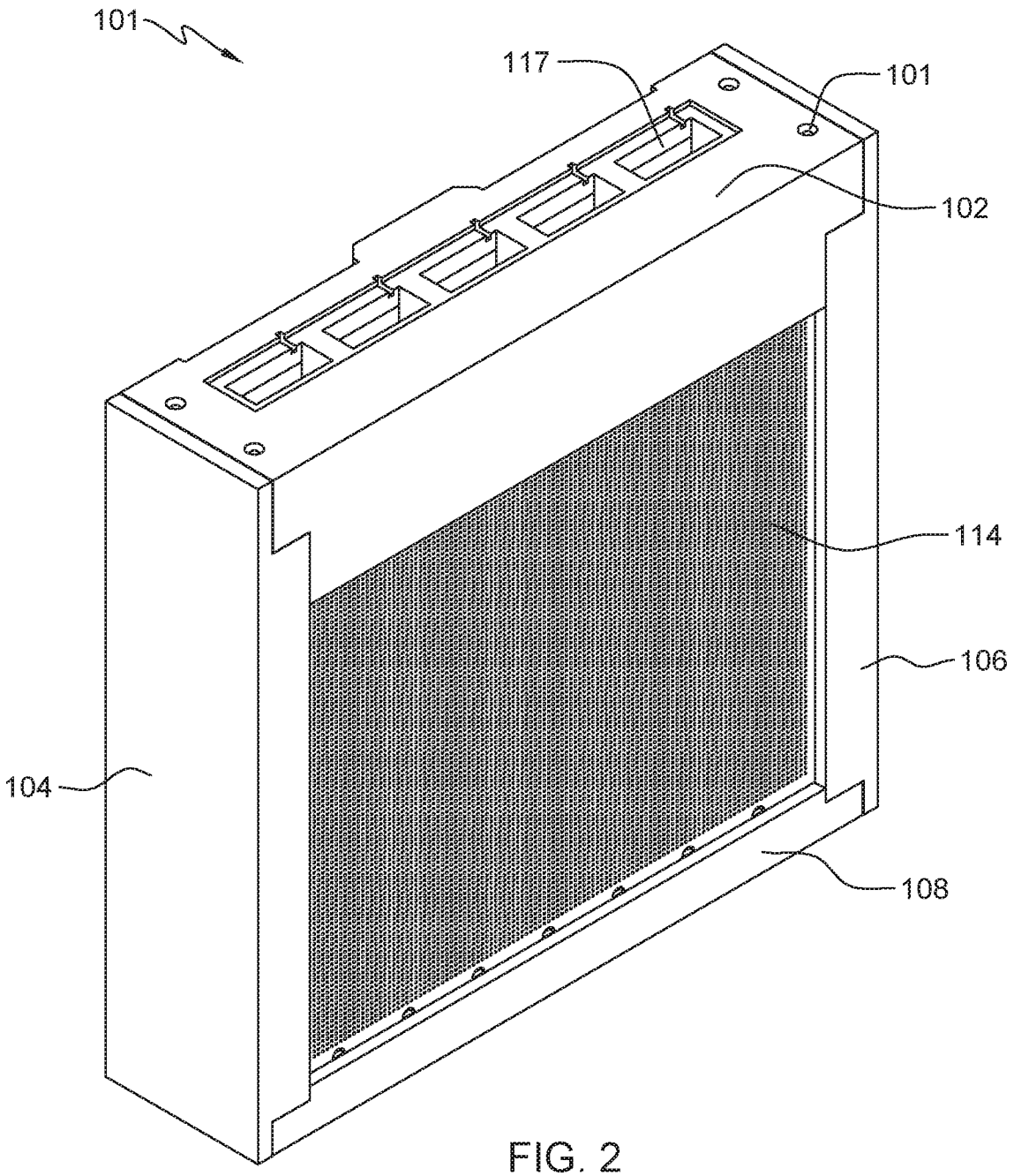
FIG. 2 depicts an isometric view of a rear view of the window, in accordance with one embodiment of the present invention.
Figure 4:
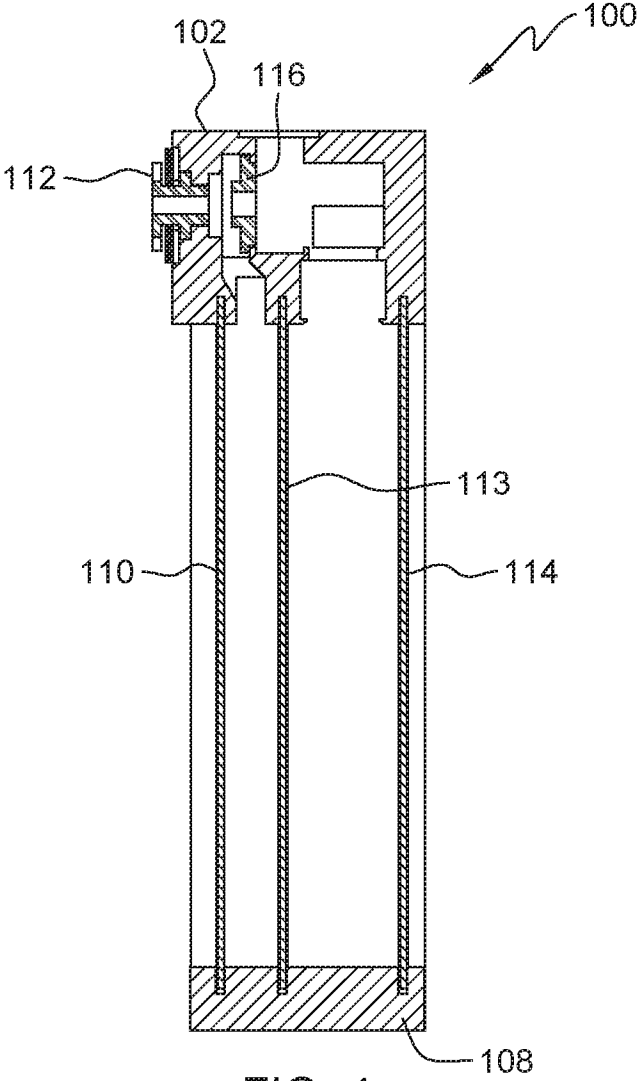
FIG. 4 depicts a side view of the section view of the window, in accordance with one embodiment of the present invention.
Figure 3:
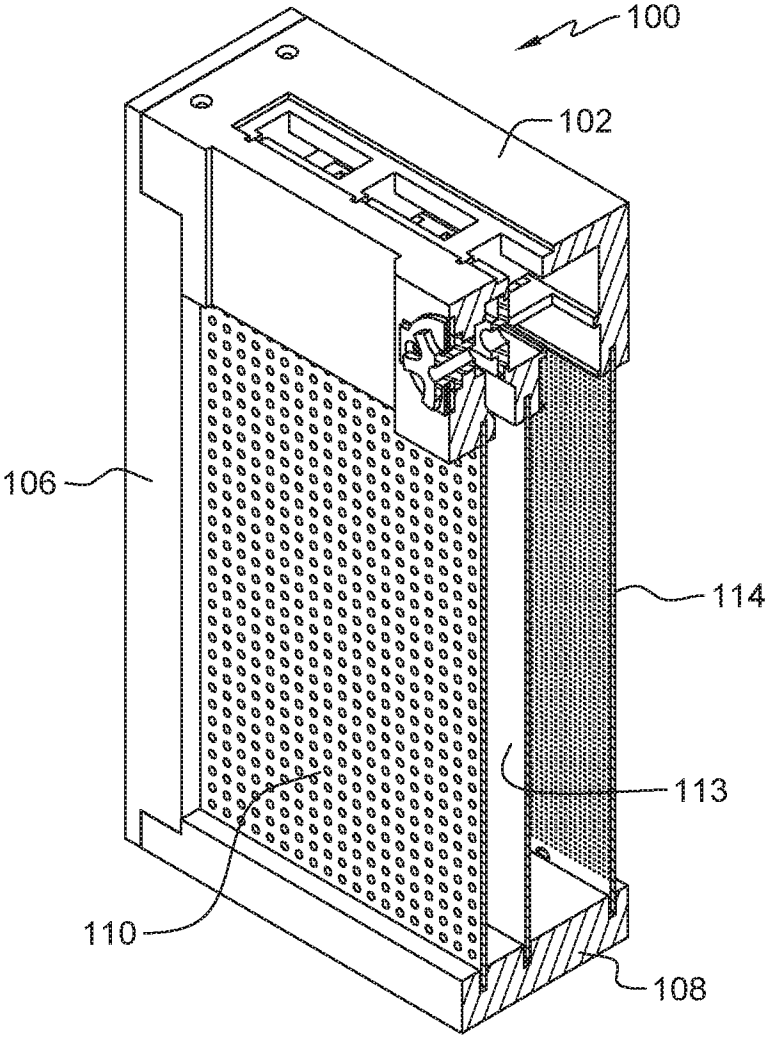
FIG. 3 depicts a section view of the window, in accordance with one embodiment of the present invention.
Figure 5:
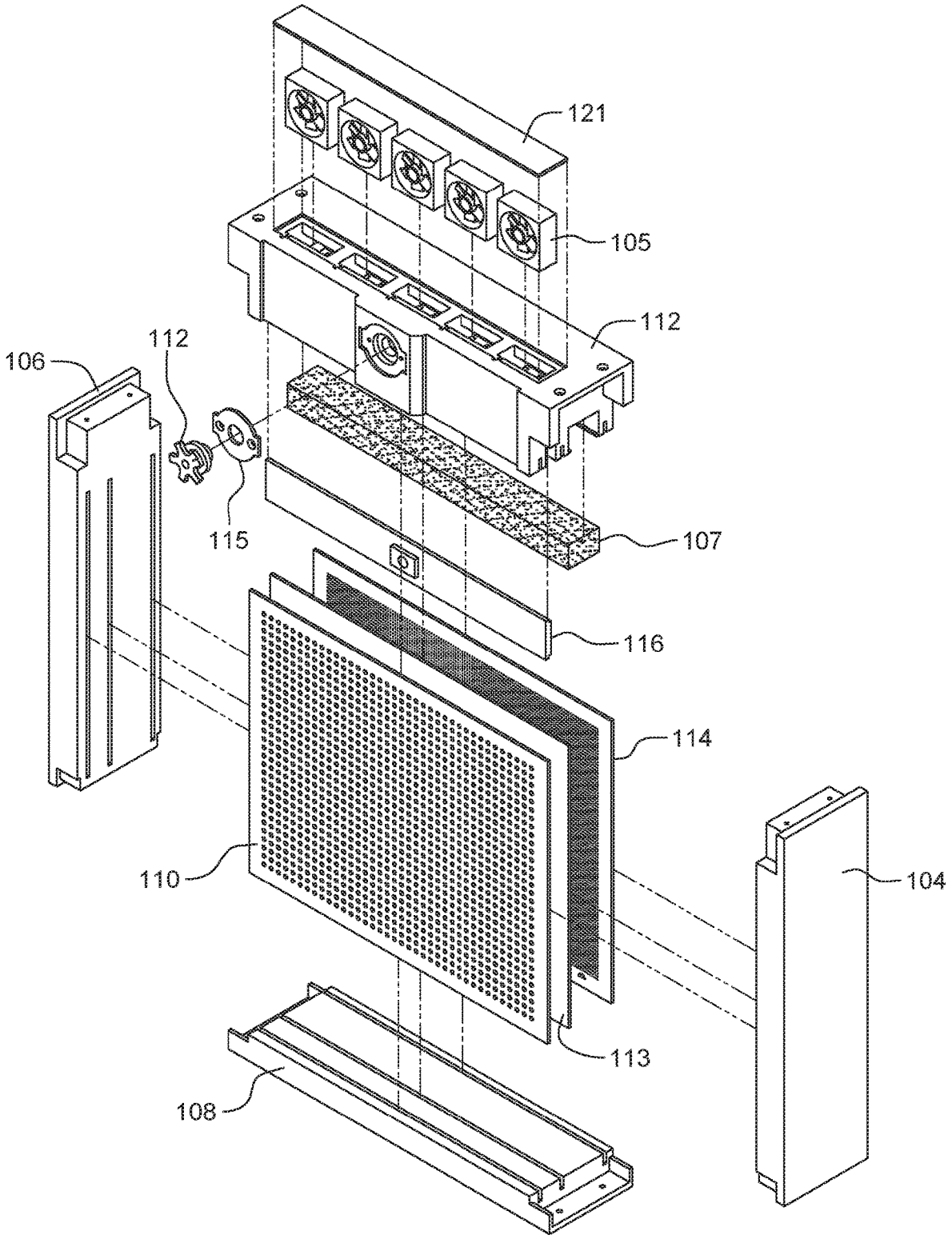
FIG. 5 depicts an exploded view of the window, in accordance with one embodiment of the present invention.

The present invention provides the benefit of circulating and fresh outside indoors. Given the various health benefits of breathing fresh air, ranging from reduced risk of cardiac arrest and pulmonary diseases to increased brain function, this products' benefits are obvious. It will essentially provide its users with clean, purified air regardless of their outside environment. Through a unique three pane design, this product is able to stop a majority of particulates and pathogens from entering the enclosed side of the device while simultaneously maintaining airflow through the device with minimum power consumption. Not only will this increase air quality inside the premise, it will reduce the need for excessive spending on air conditioning and central heating. Furthermore, due to the presence of a nano-filter unit, the amount of noise entering from the outside will be significantly lower. This invention provides additional benefits in cities, high rises, and congested areas where space is most valuable and the integration of an air purification system into the windows increases the person's livable space. Unlike a traditional window, it does not need to be "opened" to allow the entrance of air. This is beneficial on higher floors due to safety concerns The structure contains three panes, with primary airflow occurring at the top of a window frame through a filter unit placed in between the outside and middle layers. Air is pulled in through the outside pane by an array of fans located in the central frame, gets filtered as it passes through a High-Efficiency Particulate Arrestor (HEPA) filtration unit and exits through the micro-holes in the pane of glass closest to the interior environment.

The device provides for an integrated window purification system that is able to stop a majority of particulates and pathogens from entering while simultaneously maintaining airflow in and out of the room. The window's transparency should be unaffected, and the final product should be of a usable thickness.

FIGS. 1-7 depicts various view of the window frame 100 and the portion of the window frame 100 elements, in accordance with one embodiment of the present invention. FIGS. 1-7 provides an illustration of one embodiment and does not imply any limitations regarding the environment in which different embodiments maybe implemented.

The window frame 100 is comprised of a top frame member 102, a first side frame member 104, a second side frame member 106, and a bottom frame member 108, an exterior screen 110, a pane 113, and an interior screen 114. The frame members are used to secure the screens and panes in place and provide a strong exterior frame similar to that of current window designs and made from similar materials as current windows. In the depicted embodiment, the top frame member 102 has the integrated filtration system. In various embodiments the filtration unit may be integrated into the first side frame member 104, the second side frame member 106, or the bottom frame member 108 depending on the intended application of the window frame 100. In the depicted embodiment, the filtration system incorporates a plurality of fans 105, a filter 107, a control mechanism 112, and a control flap 116. In some embodiments, the screens and pane are equal distances between one another. In one embodiment, the screens and pane are spaced approximately 15 mm or less. In additional embodiments, various other distances may be employed based on the intended outcome and desired effect of the device.

In some embodiments, the frame 100 may have various channels and openings to permit water and debris to exit the frame and the space between the panes and screens. Typically the channel is located on the bottom frame member 108 where water is most likely to gather after cleaning or rain.

In the depicted embodiment, the top frame member 102 has a plurality of openings 101 which are designed to have a fastener threaded down into the side frame members 104 and 106 to secure the frame members together. A similar securing method would be incorporated into the lower frame member 108 and up through the side frame members 104 and 106. In additional embodiments, various methods to secure the four frame members together can be employed known by those skilled in the art to allow for the frame members to be detachable from one another. In the depicted embodiment, the control mechanism 112 is secured to the top frame member 102 via a mounting disk 115, and is secured using fasteners or the like.

In some embodiments, the pane 113 may have electrochromic properties to allow the user to control the amount of light and heat passing through the pane 113. In additional embodiments, the screens 110 and 114 may be adjustable so that the user can raise or lower the screens. In some embodiments, a solar panel film may be applied to the pane 113 to gather energy to charge a battery or power the fans 105. In additional embodiments, the exterior surface of the frame members may have a solar panel film applied as well.

The exterior screen 110 and the inside screen 114 are studded with micro-openings to allow for the flow of air through the filtration system and into the interior space. In one embodiment, the exterior screen 110 has a thickness of 3 mm lined with roughly two thousand 1 mm in diameter openings, the interior screen 114 has a thickness of 3 mm and is perforated with openings that are 3 mm in diameter and spaced 3 mm apart. This provides for a high level of transparency through the screens and pane, which also reducing the ability for large particles or particulate matter to enter into the filtration system. In various embodiments, the thickness and number of openings in the screens may be adjusted. The screens may be manufactured through sterolithography. These screens maybe removable through various locking mechanisms integrated into the window frame members to allow for the cleaning or replacing of the screens.

The pane 113 is made of a solid transparent material, such as glass, polycarbonate, or clear material that is also impermeable. In some embodiments, the pane 113 is permanently affixed to the frame members and is not removable.

Filter 107 is a fibrous or porous material that is used to remove solid particulates from the air. In one embodiment, the filter 107 is a high efficiency particulate air (HEPA) filter. Various other filters known in the art may be implemented.

Fans 105 assists in moving the air from the exterior environment, through the filter 107, and push the air into the interior environment through the window frame 102. Various types of fans 105 may be used, such as, but not limited to static pressure fans or air flow fans. In various embodiments, the fans 105 may have variable speeds, the ability to rotate clockwise or counterclockwise. In the depicted embodiment, five (5) fans are used within the top frame member 102. The incorporation of the multiple fans provides for an increase in the diffusion of the air within the interior environment. The fans provide additional support to assist the air in overcoming the high resistance of the filter 107. In one embodiment, the fans are 50×50×20 mm capable of producing maximum speeds of 4500 RPM and volumetric flow rates of 27 cubic feet per meter.

In the depicted embodiment, the fans 105 fit within the openings 117 in to top frame member 102 and are secured in place by a cover plate (not shown) the is secured to the top frame member 102 over the fans. This allows easy access to the fans is necessary to repair or replace, and also assist in reducing the noise within the room from the fans 105.

In one embodiment, the bottom frame member 108 has a plurality of slots 109 within a channel 107 that allow for the passage of water which may gather between the two layers during rain or condensation which may form on the panel 112. The water gathers in the channel 107 and exits the bottom frame member 108 through the slots 109. In some embodiments, the slots 109 are covered by a mesh or netting, so that only liquid is able to pass through the slots 109 and larger particulate matter is held in the mesh for removal. This provides the benefit of the slots 109 becoming clogged or blocked by the particulate matter.

In the depicted embodiment, the primary airflow occurs through the top frame member 102. The entry for the air into the filtration system is located between the pane 113 and the exterior screen 110, and after passing through the filtration system, the air exits through an exhaust slot into the interior environment.

Figure 6:
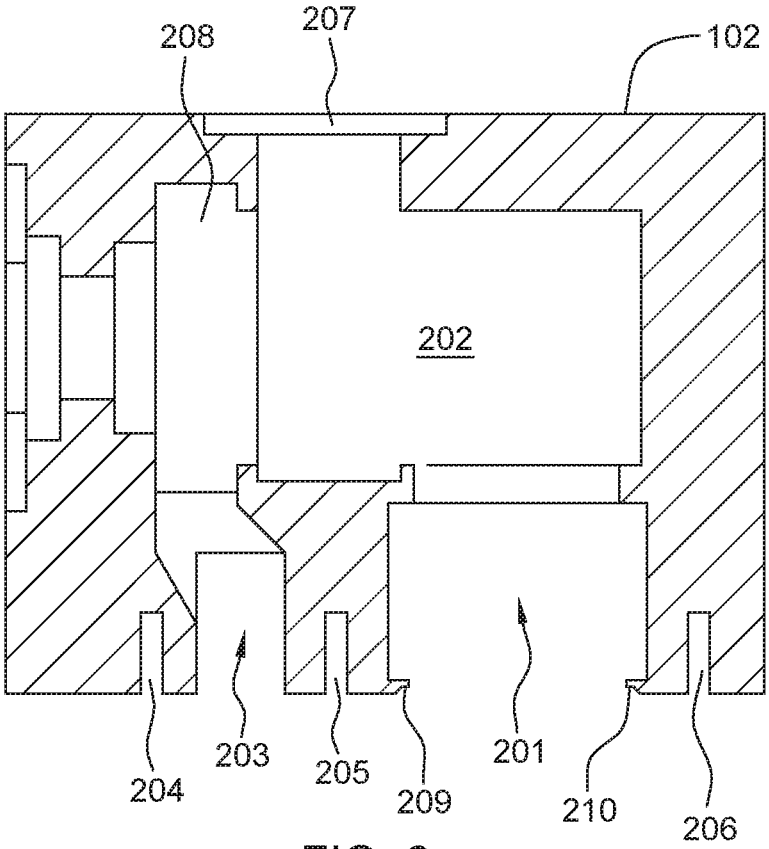
FIG. 6 depicts a section view of a top window frame, in accordance with one embodiment of the present invention.
Figure 7:
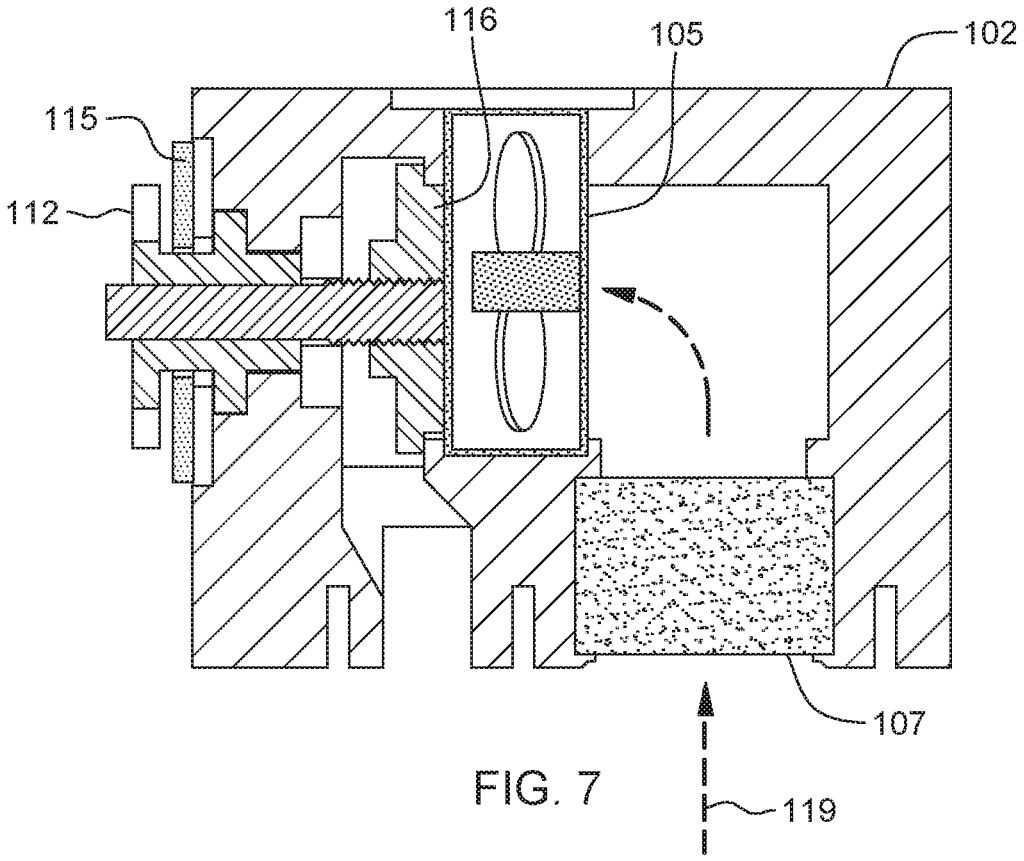
FIG. 7 depicts a section view of the top window frame assembly in a closed position, in accordance with one embodiment of the present invention.
Figure 8:
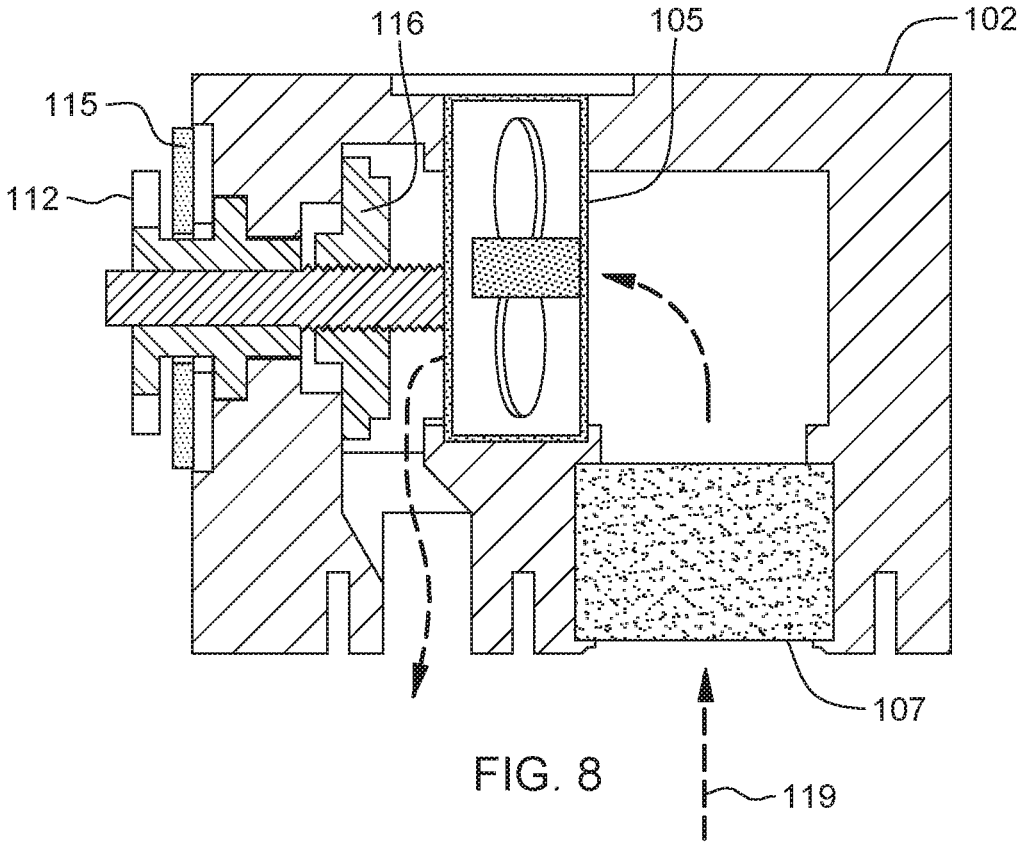
FIG. 8 depicts a section view of the top window frame assembly in an open position, in accordance with one embodiment of the present invention.

FIGS. 6-8 depict the top frame member 200 and components, in accordance with one embodiment of the present invention. The depicted embodiment of top frame member 200 is the same element as depicted in FIGS. 1-5.

FIG. 6 depict an embodiment, the top frame member 102 is comprised of several internal chambers, which provide for the passage of the exterior air from the exterior environment to the interior environment. The air enters from the exterior environment through section 201, into section 202, through section 208, and exits through section 203 into the interior environment. Slot 204 secures exterior screen 110. Slot 205 secures pane 113. Slot 206 secures interior screen 114. Slot 207 provides a slot for the fan cover 121 to be inserted into so that the top surface of the top frame member 102 is substantially flush.

FIGS. 7-8 depict an embodiment of the top frame member 102 and components in the closed (FIG. 7) and open (FIG. 8) positions. Section 201 is designed to securely fit the filter 107 in place. In the depicted embodiment, the top frame member 102 has extensions 209 and 210 to secure the filter 107 in place. Section 201 is sized to securely fit filter 107 with substantially no additional space for air to pass around filter 107. The extensions 209 and 210 allow for easy remove of the filter 107 for replacement or cleaning. Section 202 is shown with a fan 105 fitted within through opening 115 in the top frame member 102. Opening 115 is sized to allow the insertion of fan 105 into section 202. Slot 207 allows for a cover 121 to be placed over the fans 105 to secure them in place. Fans 105 provide for controlling the flow of the air into the internal environment.

The control flap 116 is shown in the closed position in FIG. 7 wherein it is pressed against the fan and does not allow air to pass through sections 208 and 203. When the control mechanism 112 is adjusted, the control flap 116 is repositioned (FIG. 8) to allow for air to flow through sections 208 and 203. In the depicted embodiment, the control flap 116 is secured to the control mechanism 112 through a threaded fastener. Through the adjustment to the control mechanism 112 (in the depicted embodiment, turning the knob) the control flap 116 is adjusted from a first position to a second position and various positions in-between to allow for an adjustable amount of air flow.

Figure 9:
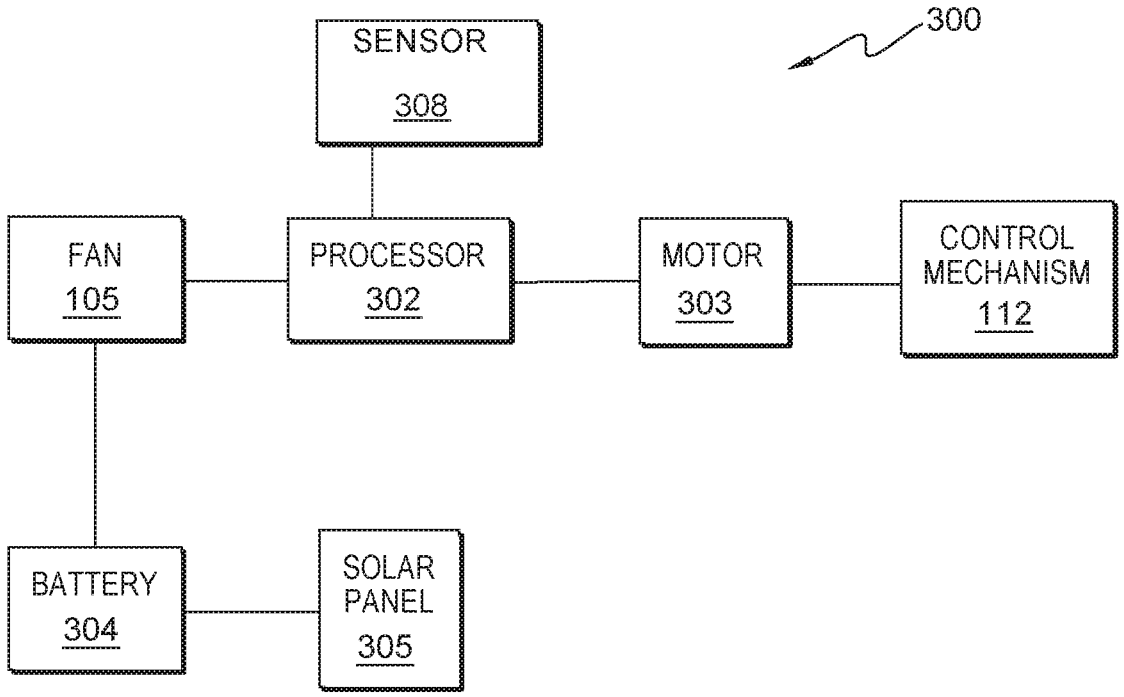
FIG. 9 depicts a block diagram of the electrical components of the window, in accordance with one embodiment of the present invention.

FIG. 9 depicts a block diagram of the electrical components of the window, in accordance with one embodiment of the present invention. In some embodiments, a computer circuit system 300 is integrated into the window to provide control of the fans 105 and/or the control mechanism 105 and processing of energy from the solar panel. In some embodiments, each fan 105 is independently controlled by the computer circuit system 300. In some embodiments, the computer circuits 300 system has a wireless communication ability to control the fans 100 (e.g. on/off and speed) and adjust the control mechanism 105. In some embodiments, the computing device integrated into the window allows for control of the fan speed based on user defined requirements such as desired air flow at predetermined time of the day, a desire to increase the amount of air directed into the room, a desire for a set air speed, etc. In some embodiments, the window frame 100 has sensors 308 which detect the conditions of the interior room (humidity, temperature, air quality, light intensity, sunlight, rain fall, etc.) and can adjust the fan speed automatically to accommodate preset requirements. In additional embodiments the computer circuit system 300 may have wired or wireless connectivity to allow for control and monitoring of the various components remotely. For example by a mobile phone, smart phone, or various computing devices.

In some embodiments, the flap 116 and the control mechanism 112, when in a first closed position the fan is off and when the flap 116 is moved towards the second position, the fan is activated so as to not have the fan constantly on when the flap 116 is not permitting the air to enter the interior space. In one embodiment, the computer circuit system 300 is designed to be operated remotely from an external wirelessly attached computing device.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A ventilated window frame comprising:

a frame having a first side, a second side, a plurality of slots along an interior edge, and a series of connected internal cavities;

a first permeable layer fitted within a first slot of the plurality of slots distal to the first side;

a second permeable layer secured within a second slot of the plurality of slots distal to the second side;

a non-permeable layer secured within a third slot of the plurality of slots between the first and second permeable layers, wherein a first opening of the series of connected internal cavities is between the first permeable layer and the non-permeable layer and a second opening of the series of connected internal cavities is located between the second permeable layer and the non-permeable layer;

a filter inserted within one of the series of connected internal cavities; and at least one fan fitted within the series of connected internal cavities.

2. The ventilated window frame of claim 1, further comprising an adjustable flap positioned within the series of connected internal cavities.

3. The ventilated window frame of claim 2, further comprising a knob attached to the flap, wherein the control mechanism adjusts the position of the flap.

4. The ventilated window frame of claim 1, further comprising a solar panel secured to the non-permeable layer.

5. The ventilated window frame of claim 1, wherein the first permeable layer has a first plurality of openings of predetermined size, wherein the first permeable layer is substantially transparent.

6. The ventilated window frame of claim 1, wherein the second permeable layer has a second plurality of openings of predetermined size, wherein the second permeable layer is substantially transparent.

7. The ventilated window frame of claim 1, further comprising a airtight cover, wherein the cover is secured to the frame distal to the at least one fans.

8. The ventilated window frame of claim 1, wherein the plurality of slots are a predetermined distances from one another.

9. The ventilated window frame of claim 4, further comprising a battery integrated into the frame, wherein the battery is electrically connected to the solar panel and the at least one fan.

10. The ventilated window frame of claim 1, further comprising a plurality of fans fitted between the first opening and the second opening of the frame.

11. The ventilated window frame of claim 3, wherein the control mechanism is connected to the flap by a threaded rod, wherein when the control mechanism is rotated the flap moves from a first position to a second position.

12. A ventilated window frame comprising:

a window frame comprised:

a first side member, a second side member, a lower base member connected to the first and second side members, and an upper base member having a channel with an inlet and an outlet, wherein the channel is comprised of a first chamber, a second chamber, a third chamber, and a fourth chamber;

a plurality of fans secured within the channel;

a filter fitted within the channel;

a first permeable layer secured within the window frame distal to a first side;

a second permeable layer secured within the window frame distal to a second side;

a nonpermeable layer secured within the window frame between the first and second permeable layers;

a flap positioned within the channel;

and a control mechanism connected to the flap, where adjusting the control mechanism moves the flap from a first position to a second position;

wherein, the inlet is positioned between the first permeable layer and the nonpermeable layer a nd the outlet is positioned between the nonpermeable layer and the second permeable layer.

13. The ventilated window frame of claim 12, further comprising a cover, wherein the cover is secured over a plurality of slots wherein a substantially airtight seal is formed.

14. The ventilated window frame of claim 12, wherein the filter is fitted within the first chamber and the plurality of fans are situated in the second chamber, the flap is situated within the third chamber.

15. The ventilated window frame of claim 12, further comprising a sensor connected to the plurality of fans.

16. A ventilated window frame comprising:

a window frame comprised:

a first side member, a second side member, a lower base member connected to the first and second side members, and an upper base member having a channel with an inlet and an outlet, wherein the channel is comprised of a plurality of slots;

a plurality of fans secured within the plurality of slots;

a filter fitted within the channel;

a first permeable layer secured within the window frame distal to a first side;

a second permeable layer secured within the window frame distal to a second side;

a nonpermeable layer secured within the window frame between the first and second permeable layers;

a flap positioned within the channel; and a control mechanism connected to the flap, where adjusting the control mechanism moves the flap from a first position to a second position;

wherein, the inlet is positioned between the first permeable layer and the nonpermeable layer and the outlet is positioned between the nonpermeable layer and the second permeable layer.

* * * * *